US008413337B2

(12) United States Patent
Price

(10) Patent No.: US 8,413,337 B2
(45) Date of Patent: Apr. 9, 2013

(54) DUAL FRONT UTILITY KNIFE WITH INTERLOCK

(75) Inventor: Martin Charles Price, Wakefield (GB)

(73) Assignee: Stanley Black & Decker, Inc., New Britain, CT (US)

( * ) Notice: Subject to any disclaimer, the term of this patent is extended or adjusted under 35 U.S.C. 154(b) by 454 days.

(21) Appl. No.: 12/366,513

(22) Filed: Feb. 5, 2009

(65) Prior Publication Data

US 2010/0126024 A1 May 27, 2010

Related U.S. Application Data

(60) Provisional application No. 61/116,834, filed on Nov. 21, 2008.

(51) Int. Cl.
*B26B 1/08* (2006.01)

(52) U.S. Cl. ..... 30/152; 30/162; 30/335; 30/304

(58) Field of Classification Search ..... 30/125, 30/152, 155–162, 304, 335; 7/118, 132–135, 7/160, 167; 401/29–35
See application file for complete search history.

(56) References Cited

U.S. PATENT DOCUMENTS

| | | | | | |
|---|---|---|---|---|---|
| 338,612 | A | * | 3/1886 | Pusey | 7/118 |
| 1,953,690 | A | * | 4/1934 | Samways | 7/167 |
| 2,604,693 | A | * | 7/1952 | Schierstead | 30/152 |
| 2,821,724 | A | * | 2/1958 | Wurgaft | 7/167 |
| 3,577,637 | A | | 5/1971 | Braginetz | |
| 3,750,729 | A | * | 8/1973 | Lemieux | 81/439 |
| 3,967,377 | A | * | 7/1976 | Wells | 30/320 |
| 4,472,879 | A | * | 9/1984 | Sizemore, Jr. | 30/304 |
| 4,586,256 | A | | 5/1986 | Weimann | |
| 5,337,481 | A | | 8/1994 | Mears | 30/162 |
| 5,584,123 | A | | 12/1996 | Chi | 30/125 |
| 5,964,132 | A | * | 10/1999 | Chen | 81/439 |
| 6,148,522 | A | | 11/2000 | Dobandi | 30/162 |
| 6,192,589 | B1 | | 2/2001 | Martone et al. | |
| 6,550,143 | B1 | | 4/2003 | Derome | 30/162 |
| 6,971,178 | B2 | | 12/2005 | Rowlay | |
| 7,296,354 | B2 | | 11/2007 | Van Deursen et al. | |
| 7,603,779 | B2 | | 10/2009 | Rowlay | 30/162 |
| 2005/0144787 | A1 | | 7/2005 | Macri | 30/142 |
| 2008/0086822 | A1 | * | 4/2008 | Elsener | 7/118 |
| 2009/0199408 | A1 | * | 8/2009 | Zeng | 30/152 |
| 2009/0223063 | A1 | | 9/2009 | Hallquist et al. | 30/162 |
| 2009/0293284 | A1 | * | 12/2009 | Avery et al. | 30/152 |

* cited by examiner

OTHER PUBLICATIONS

Extended European Search Report as issued for European Patent Application No. 09175013.3, dated Apr. 7, 2010.

*Primary Examiner* — Laura M. Lee
(74) *Attorney, Agent, or Firm* — Pillsbury Winthrop Shaw Pitman LLP

(57) ABSTRACT

A utility knife includes a handle, a first blade holder assembly, a second blade holder assembly, and an interlock assembly. The handle includes an opening at a front end. The first blade holder assembly is constructed and arranged to hold a first blade at a position of use wherein the first blade projects through the opening at the front end of the handle, and to retract the first blade into the handle. The second blade holder assembly is constructed and arranged to hold a second blade at a position of use wherein the second blade projects through the opening at the front end of the handle, and to retract the second blade into the handle. The interlock assembly constructed and arranged to allow only one of the first blade and the second blade to project through the opening at the front end of the handle.

9 Claims, 23 Drawing Sheets

DUAL FRONT UTILITY KNIFE WITH INTERLOCK

The present application claims priority to U.S. Provisional Application Ser. No. 61/116,834, filed on Nov. 21, 2008, the entirety of which is hereby incorporated herein.

BACKGROUND OF THE INVENTION

Field of the Invention

The present invention relates utility knives, and, more particularly to a utility knife with a plurality of blades that can be extended outwardly from a handle.

Cutting devices, such as utility knives, have been developed for use in various applications, such as, for example, construction, packaging and shipping, carpet installation, as well as other purposes.

A utility knife may include a handle that provides a gripping surface to enable the handle to be gripped in a hand of a user during a cutting operation. One or more cutting blades may be mounted on a blade carriage that is movably mounted within the handle assembly. The blade carriage is operable to carry its associated blade between extended and retracted positions.

SUMMARY OF THE INVENTION

One aspect of the present invention provides a utility knife. The utility knife includes a handle, a first blade holder assembly, a second blade holder assembly, and an interlock assembly. The first blade holder assembly is constructed and arranged to releasably hold a first replaceable blade at a position of use wherein the first blade projects outwardly from the front end of the handle, and to retract the first blade into the handle. The second blade holder assembly is constructed and arranged to releasably hold a second blade at a position of use wherein the second blade projects outwardly from the front end of the handle, and to retract the second blade into the handle. The interlock assembly constructed and arranged to allow only one of the first blade or the second blade to project outwardly from the front end of the handle.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated may be considered drawn to scale. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION OF THE INVENTION

Figure 1:
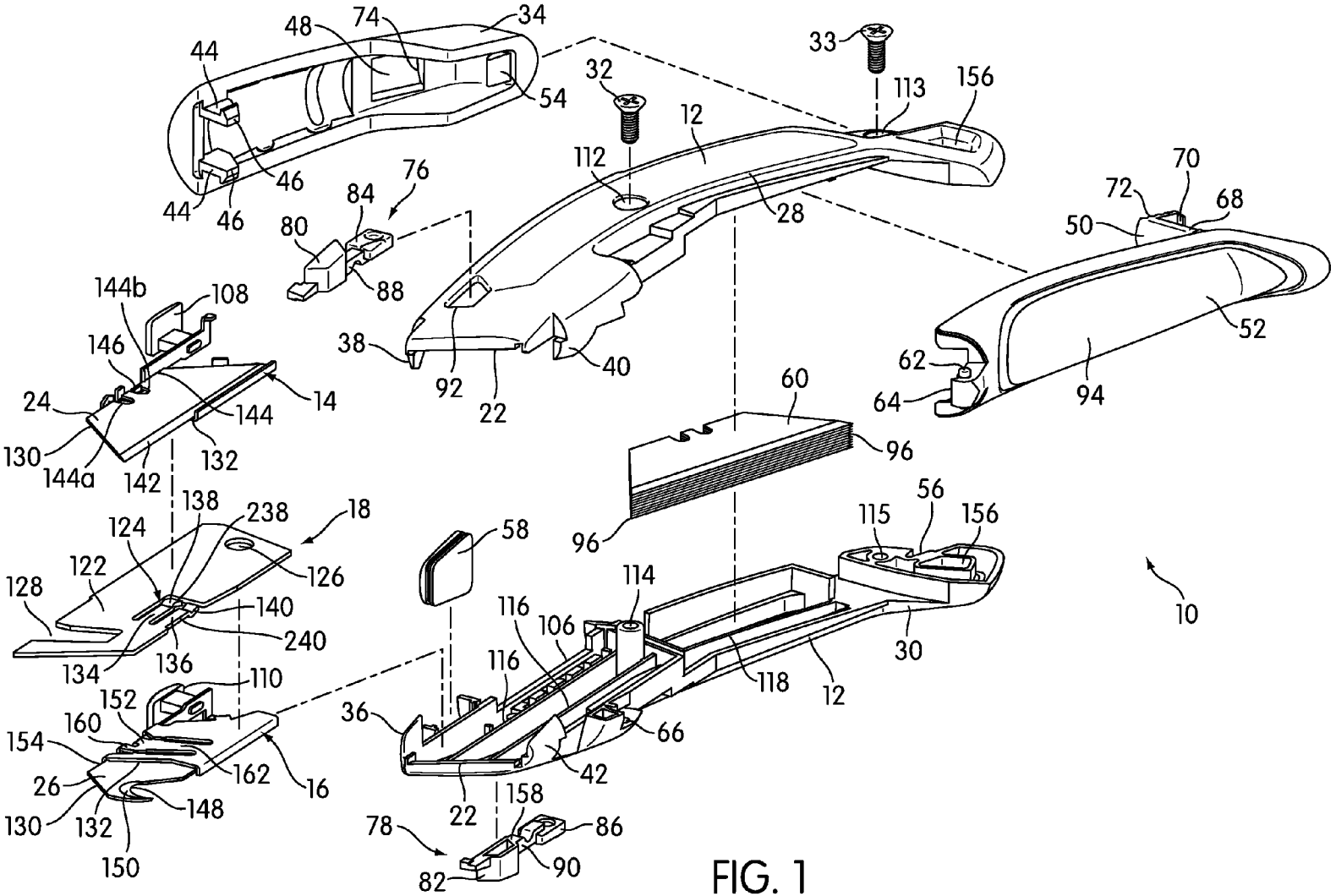
FIG. 1 is an exploded perspective view of a utility knife in accordance with an embodiment of the present invention.
Figure 2:
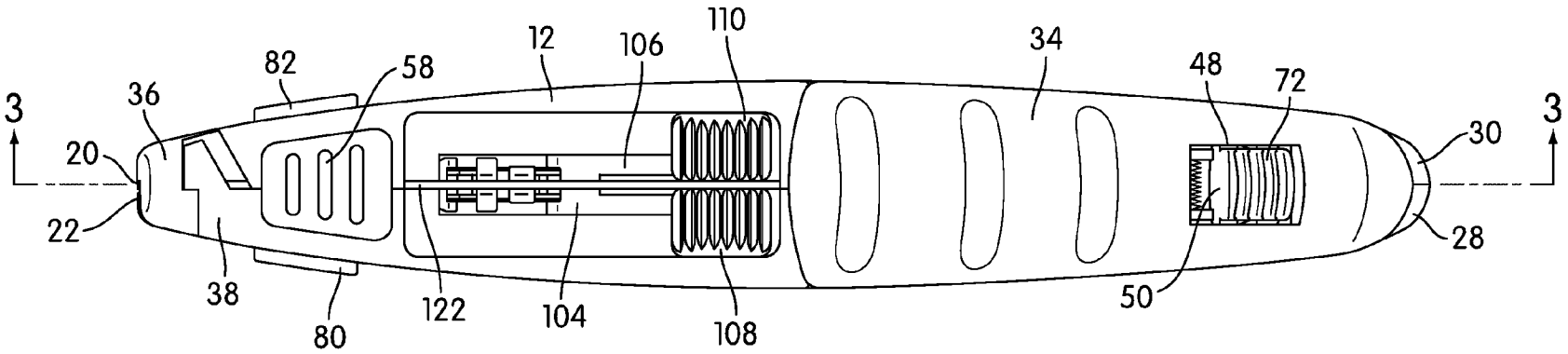
FIG. 2 is a top plan view of the utility knife, wherein a first blade and a second blade are retracted into a handle in accordance with an embodiment of the present invention.
Figure 8:
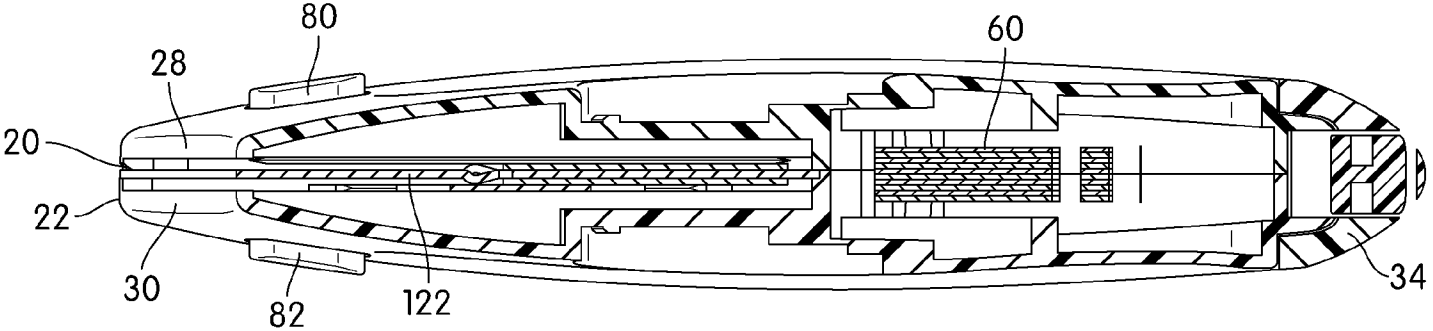
FIG. 8 is a sectional view thereof along the line 8-8 of FIG. 6 in accordance with an embodiment of the present invention.
Figure 9:
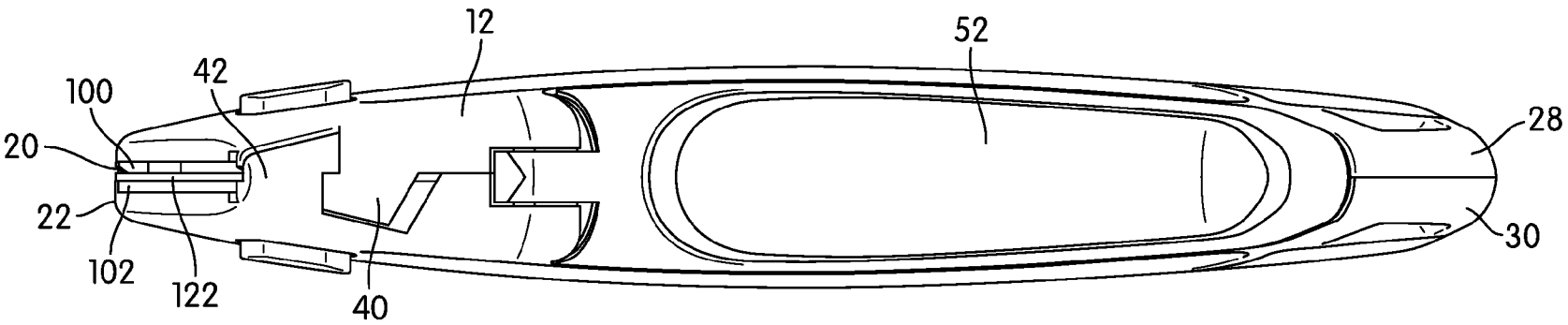
FIG. 9 is a bottom plan view of the utility knife, wherein the first blade and the second blade are retracted into the handle in accordance with an embodiment of the present invention.

FIG. 1 shows a utility knife 10 in accordance with an embodiment of the present invention. The utility knife 10 includes a handle 12, a first blade holder assembly 14, a second blade holder assembly 16, and an interlock assembly 18. The handle 12 includes an opening 20 (as shown in FIGS. 2, 8 and 9) at a front end 22. The first blade holder assembly 14 is constructed and arranged to hold a first blade 24 at a position of use wherein the first blade 24 projects through the opening 20 at the front end 22 of the handle 12, and to retract the first blade 24 into the handle 12. The second blade holder assembly 16 is constructed and arranged to hold a second blade 26 at a position of use wherein the second blade 26 projects through the opening 20 at the front end 22 of the handle 12, and to retract the second blade 26 into the handle 12. The interlock assembly 18 constructed and arranged to allow only one of the first blade 24 and the second blade 26 to project through the opening 20 at the front end 22 of the handle 12 at any one time.

Referring to FIGS. 1-10, the handle 12 is, in one embodiment, made of an appropriate metal (e.g., aluminum or steel) or other material of suitable strength (e.g., plastic) and is comprised of two mating handle portions 28, 30. The first handle portion 28 and the second handle portion 30 are secured together to form the handle 12 by threaded or other type of fasteners 32 and 33. In another embodiment, a single threaded or other type of fastener may be used to secure the first handle portion 28 and the second handle portion 30 together. In one embodiment, the exterior surface of the handle 12 is suitably contoured to assist the user in holding onto the handle 12 and to facilitate employment of the first blade 24 or the second blade 26 to perform various cutting tasks. Specifically, in one embodiment, the top portion of the handle 12 and the top portion of an upper gripping member 34 are contoured or arranged, for example slightly convex, to more comfortably accommodate the palm of the user's hand.

In one embodiment, the first handle portion 28 provides a first cooperating interlocking structure 36 and the second handle portion 30 provides a second cooperating interlocking structure 38. The first and second cooperating interlocking structures 36, 38 are configured to interlock with one another to prevent relative pivotal movement between the first and second handle portions 28, 30 of the handle 12 with respect to one another. In one embodiment, the first handle portion 28 provides a third cooperating interlocking structure 40 and the second handle portion 30 provides a fourth cooperating interlocking structure 42. The third and fourth cooperating interlocking structures 40, 42 are configured to interlock with one another to prevent relative pivotal and/or sliding movement between the first and second handle portions 28, 30 of the handle 12 with respect to one another. In one embodiment, the first and second cooperating interlocking structures 36, 38 are located near top surface portions of the first and second handle portions 28, 30 of the handle 12 respectively, while the third and fourth cooperating interlocking structures 40, 42 are located near bottom surface portions of the first and second handle portions 28, 30 of the handle 12 respectively.

Figure 11:
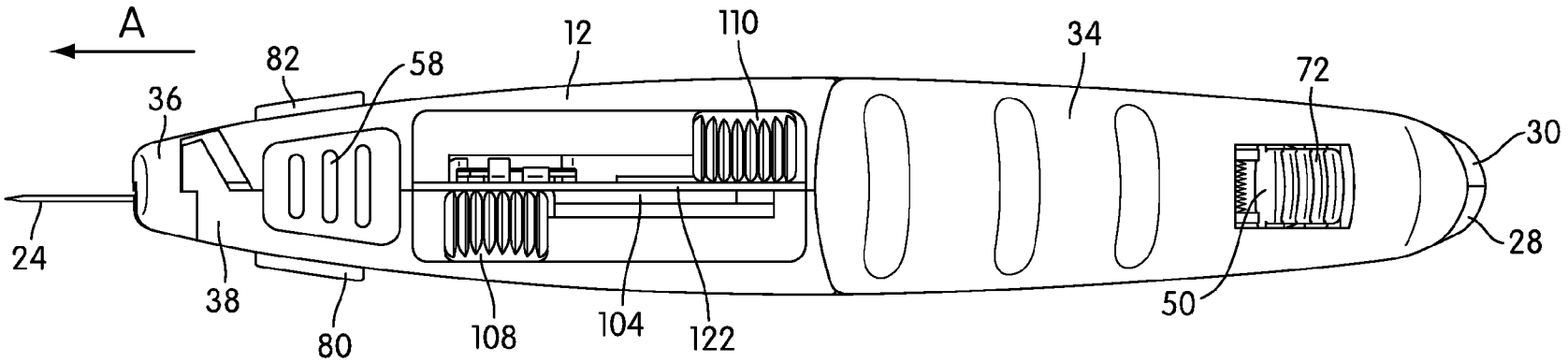
FIG. 11 is a top plan view of the utility knife, wherein the first blade projects through an opening at a front end of the handle and the second blade is retracted into the handle in accordance with an embodiment of the present invention.
Figure 14:
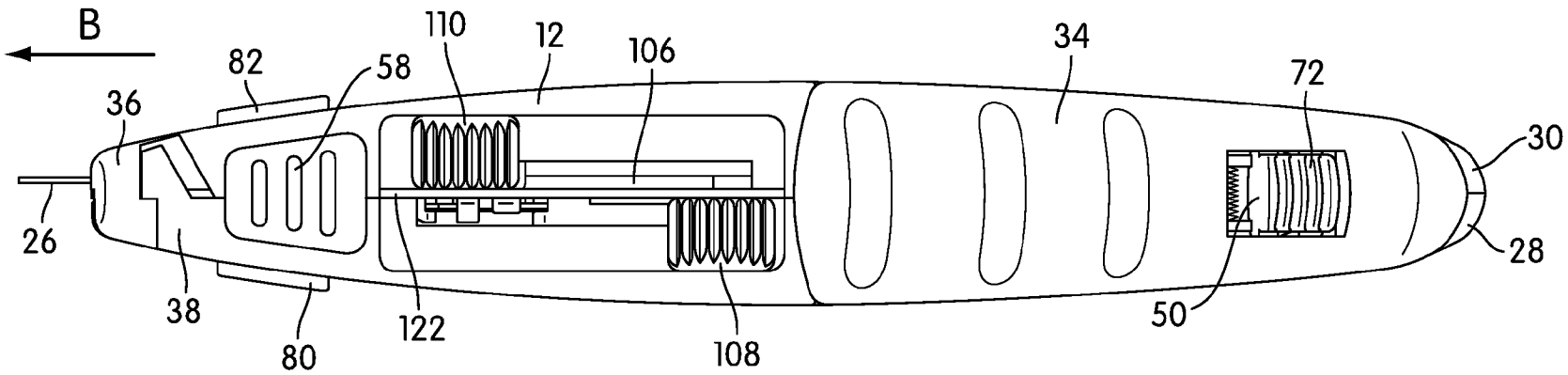
FIG. 14 is a top plan view of the utility knife, wherein the first blade is retracted into the handle and the second blade projects through the opening at the front end of the handle in accordance with an embodiment of the present invention.

The first handle portion 28 and the second handle portion 30 cooperate to form upper slots 104 (as shown in FIGS. 2 and 11) and 106 (as shown in FIGS. 2 and 14) for receiving portions of manually engageable members 108 and 110 of the first blade holder assembly 14 and the second blade holder assembly 16 respectively. The first handle portion 28 includes openings 112 and 113 that are constructed and arranged to align with openings 114 and 115 in the second handle portion 30 respectively. In one embodiment, threaded or other type of fasteners 32 and 33 that are used to secure the first handle portion 28 and the second handle portion 30 are constructed and arranged to pass through the openings 112 and 113 of the first handle portion 28 and through the openings 114 and 115 of the second handle portion 30 respectively to secure the first handle portion 28 with the second handle portion 30.

In one embodiment, the first handle portion 28 includes a plurality of ribs (not shown) located on the inner surfaces thereof. In one embodiment, the plurality of ribs in the first handle portion 28 are constructed and arranged to support the first blade holder assembly 14. In one embodiment, the second handle portion 30 include a plurality of ribs 116 located on the inner surfaces thereof. In one embodiment, the plurality of ribs 116 in the second handle portion 30 are constructed and arranged to support the second blade 26 and/or the blade holder 16 from the side. The first and the second handle portions 28 and 30 also include ribs 118. In one embodiment, the ribs 118 of the first and the second handle portions 28 and 30 are constructed and arranged to support spare blades 60 stored in a blade storage member 52.

The first handle portion 28 and the second handle portion 30 are provided with openings 92 that are constructed and arranged to slidably receive manually engageable portions 80 and 82 of blade releasing structures 76 and 78 as will be explained in the detail later.

Figure 3:
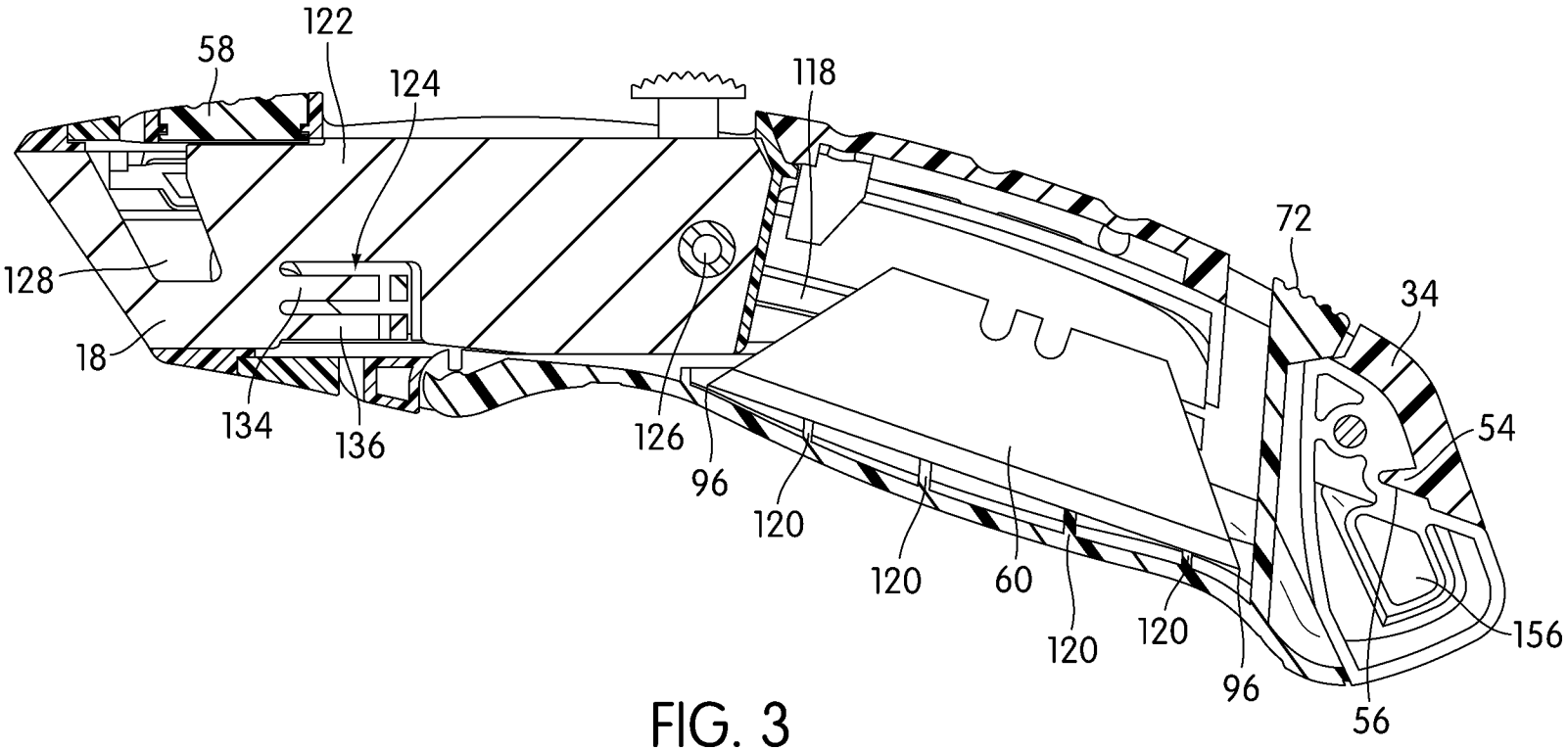
FIG. 3 is a sectional view thereof along the line 3-3 of FIG. 2 in accordance with an embodiment of the present invention.
Figure 4:
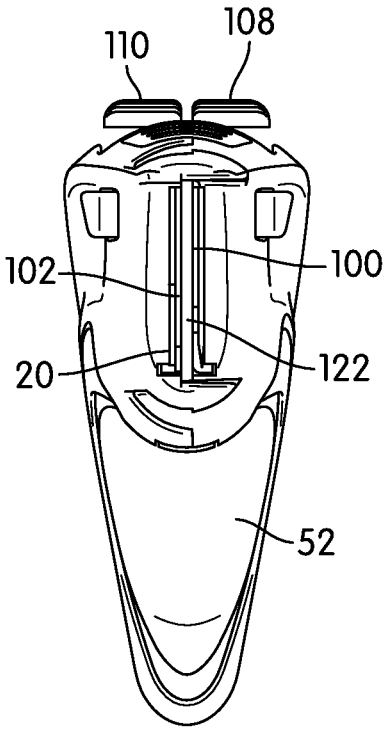
FIG. 4 is a front view of the utility knife, wherein the first blade and the second blade are retracted into the handle in accordance with an embodiment of the present invention.
Figure 5:
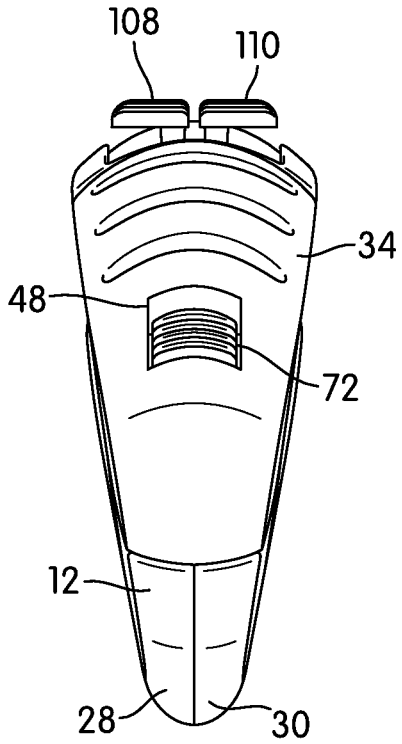
FIG. 5 is a rear view of the utility knife, wherein the first blade and the second blade are retracted into the handle in accordance with an embodiment of the present invention.
Figure 6:
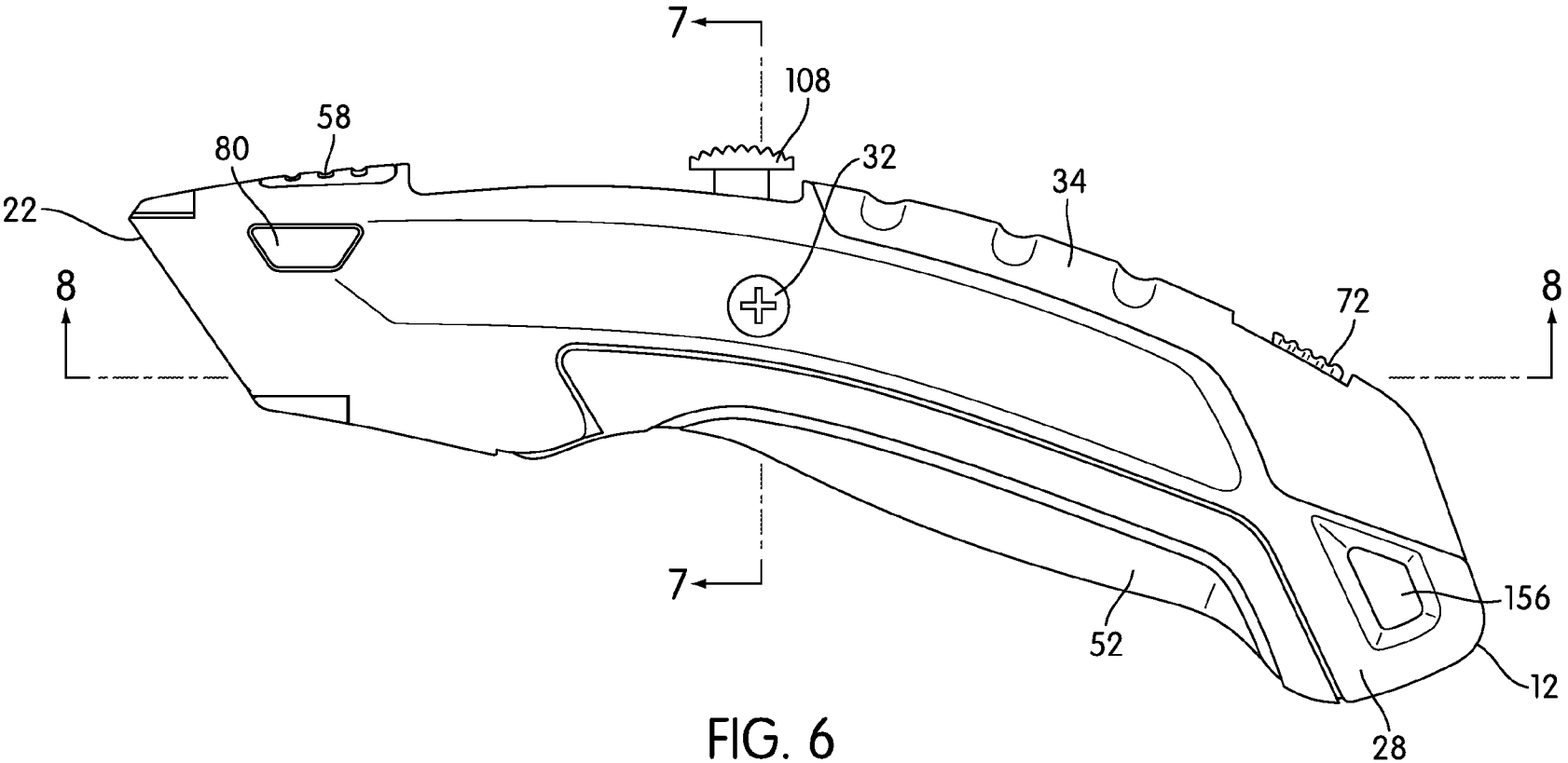
FIG. 6 is a left side view of the utility knife, wherein the first blade and the second blade are retracted into the handle in accordance with an embodiment of the present invention.
Figure 7:
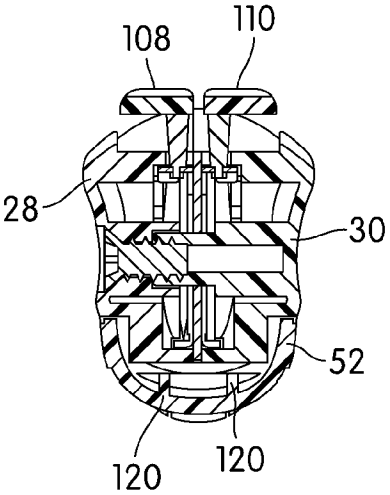
FIG. 7 is a sectional view thereof along the line 7-7 of FIG. 6 in accordance with an embodiment of the present invention.
Figure 10:
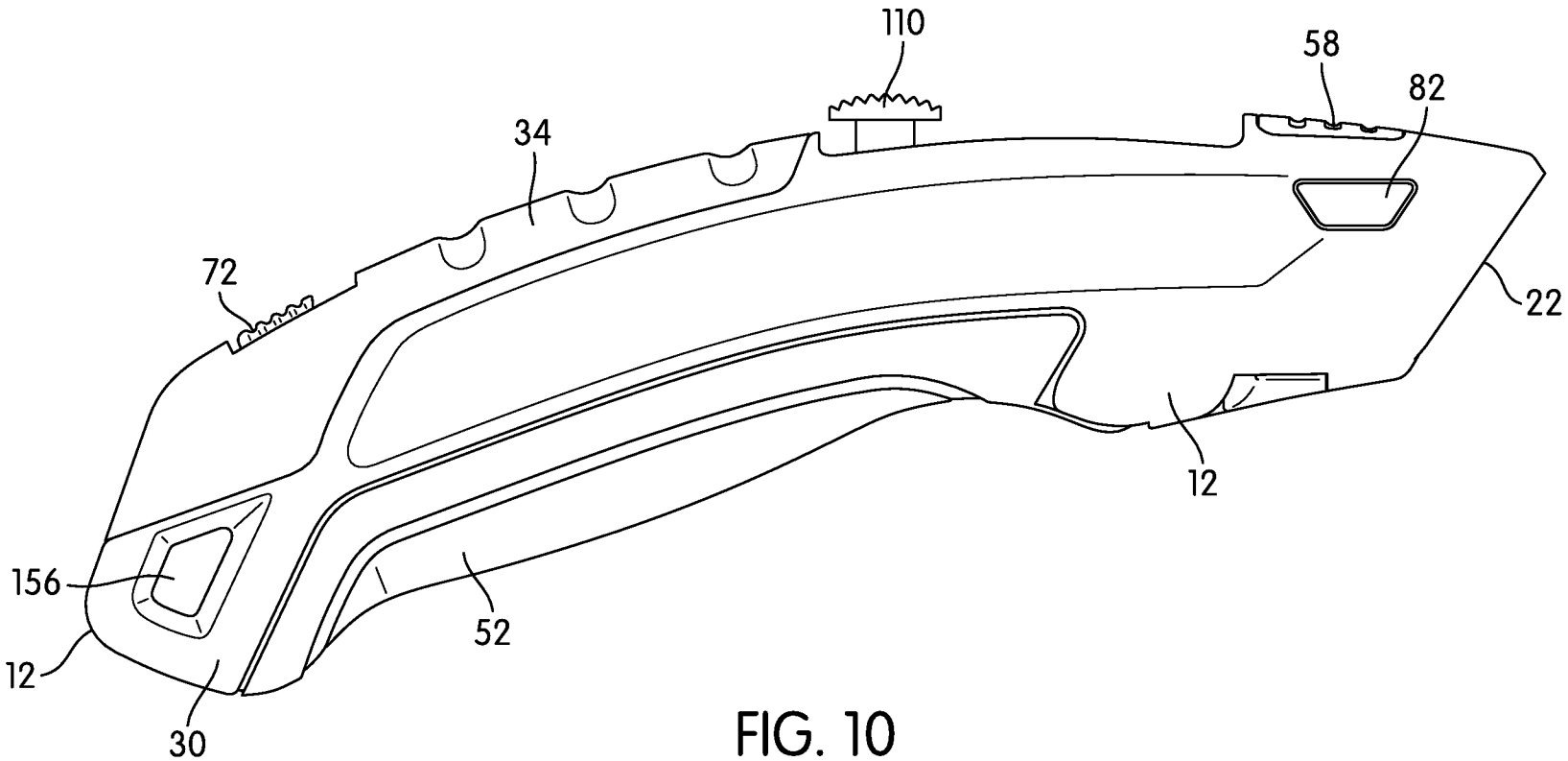
FIG. 10 is a right side view of the utility knife, wherein the first blade and the second blade are retracted into the handle in accordance with an embodiment of the present invention.

In one embodiment, openings 156 (as shown in FIGS. 3, 6 and 10) are located on the first and the second handle portions 28 and 30 closer to an end of the handle 12 that is opposite to the front end 22. In one embodiment, the openings 156 are used to hang the handle 12, for example, on a nail or a screw, for storage when the utility knife 10 is not in use.

Figure 13:
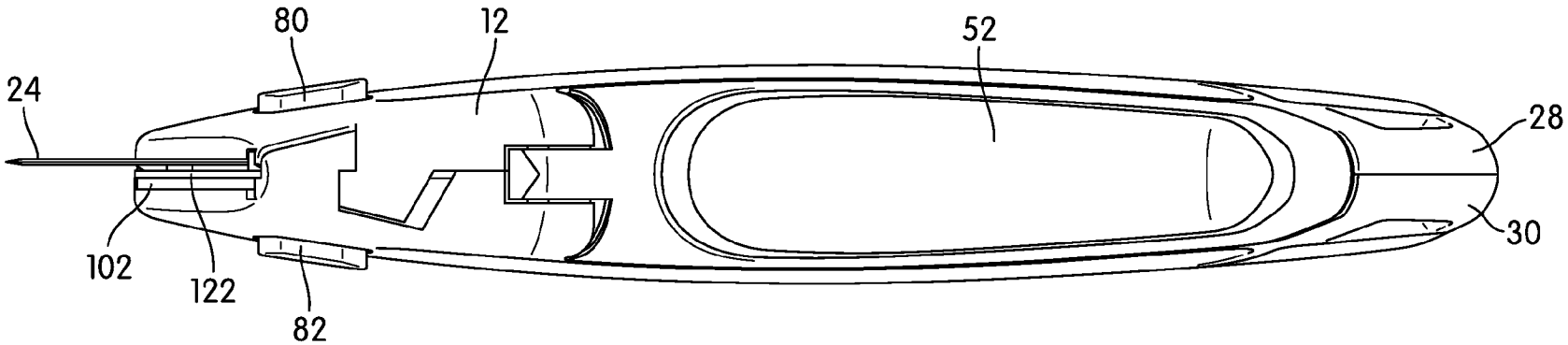
FIG. 13 is a bottom plan view of the utility knife, wherein the first blade projects through the opening at the front end of the handle and the second blade is retracted into the handle in accordance with an embodiment of the present invention.
Figure 16:
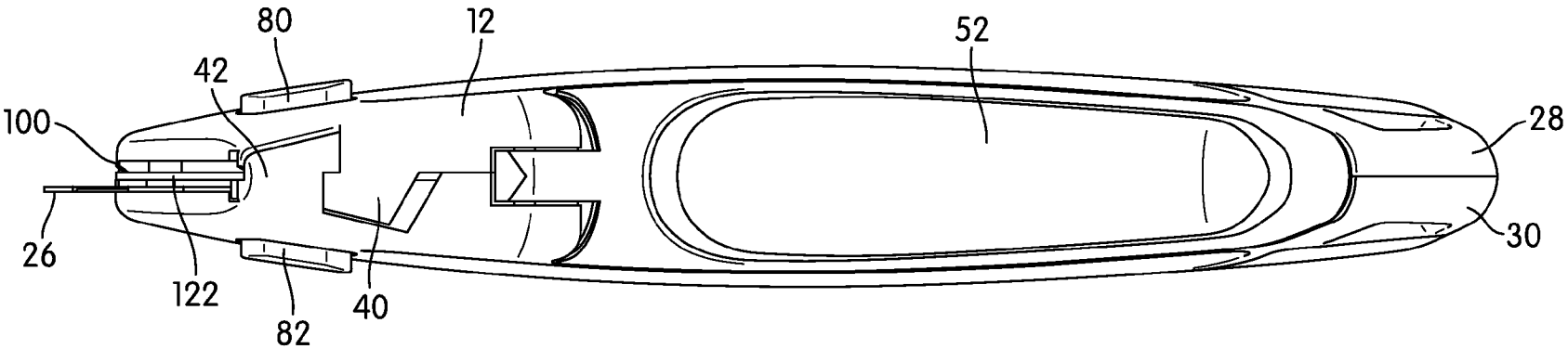
FIG. 16 is a bottom plan view of the utility knife, wherein the first blade is retracted into the handle and the second blade projects through the opening at the front end of the handle in accordance with an embodiment of the present invention.

In one embodiment, the opening 20 at the front end 22 is sized to allow one of the first blade 24 and the second blade 26 mounted in the first blade holder assembly 14 and the second blade holder assembly 16 respectively to move in and out of the handle 12. In one embodiment, the upright planar support portion 122 of the interlock assembly 18 can be provided to divide the opening 20 at the front end 22 into a first opening portion 100 (as shown in FIGS. 9 and 16) through which the first blade 24 projects and a second opening portion 102 (as shown in FIGS. 9 and 13) through which the second blade 26 projects.

In the illustrated embodiment, the first blade holder assembly 14 is movable between a retracted position (as shown in FIGS. 2 and 14) wherein the first blade 24 is disposed within the handle 12 and an extended position (as shown, for example, in FIGS. 11-13) wherein the first blade 24 protrudes outwardly (e.g., from the opening 20 at the front end 22) from the handle 12 to enable a cutting operation. The extended position may include not only a fully extended position, but may also include at least one intermediate position wherein the first blade 24 can be releasably locked at a position in which only a part of the possible cutting edge length of the first blade 24 extends from the handle 12. The manually engageable member 108 is slidably mounted within the upper slot 104 on the handle 12 and is operatively connected with the first blade holder assembly 14 such that movement of the manually engageable member 108 moves the first blade holder assembly 14 between the extended and retracted positions.

Similarly, in the illustrated embodiment, the second blade holder assembly 16 is movable between a retracted position (as shown in FIGS. 2 and 11) wherein the second blade 26 is disposed entirely within the handle 12 and an extended position (as shown, for example, in FIGS. 14-16) wherein the second blade 26 protrudes outwardly (e.g., from the opening 20 at the front end 22) from the handle 12 to enable a cutting operation. The extended position may include not only a fully extended position, but may also include at least one intermediate position wherein the second blade 26 can be releasably locked at a position in which only a part of the possible cutting edge length of the second blade 26 extends from the handle 12. The manually engageable member 110 is slidably mounted within the upper slot 106 on the handle 12 and is operatively connected with the second blade holder assembly 16 such that movement of the manually engageable member 110 moves the second blade holder assembly 16 between the extended and retracted positions.

The structure of the illustrated releasably lockable first and the second blade holder assemblies 14 and 16 are generally mirror images of each other. The structure of the illustrated blade holder assembly 14 or 16 can be of the types, for example, described in commonly assigned U.S. Pat. Nos. 4,586,256; 6,192,589; 6,971,178; or 7,296,354, that are hereby incorporated by reference in their entirety.

In one embodiment, the first and second handle portions 28, 30 of the handle 12 cooperate to retain a thumb grip member 58 (as shown in FIGS. 2, 11 and 14) in a position to receive and support the thumb of the gripping hand of the user. In one embodiment, the thumb grip member 58 is made of an appropriate molded plastic. The thumb grip member of the present invention may include different shapes, structures and/or constructions, for example, the thumb grip member of the present invention may, in one embodiment, take the form of the thumb grip member as described in commonly assigned U.S. Pat. No. 6,192,589, mentioned above.

The upper gripping member 34 is mountable on the handle 12 in a position to engage the palm of a gripping hand to provide the palm with a comfortable gripping surface. In one embodiment, the upper gripping member 34 may be made of a suitable molded plastic or elastomeric material and is snap-fit onto the handle 12. The upper gripping member 34 is provided with a pair of downwardly extending leg portions 44 that each terminate in integral hook-shaped portions 46. The handle 12 is provided with a plurality of grooves (not shown) constructed and arranged to receive the leg portions 44 and having structure that hookingly engages the hook-shaped portions 46 on the leg portions 44 to secure the upper gripping member 34 to the handle 12. In one embodiment, the upper gripping member 34 may include a hook-shaped portion 54 that is located near a rear end of the upper gripping member 34. The hook-shaped portion 54 is constructed and arranged to be received in grooves 56 located in the first handle portion 28 and the second handle portion 30, thus, further securing the upper gripping member 34 to the handle 12.

In another embodiment, the upper gripping member 34 may be integrally formed with the handle 12. In one embodiment, the upper gripping member 34 is provided with an aperture 48 configured to receive a lock structure 50 of the blade storage member 52. The upper gripping member of the present invention may include different shapes, structures and/or constructions, for example, the upper gripping member of the present invention may, in one embodiment, take the form of the upper gripping member as described in commonly assigned U.S. Pat. No. 6,192,589, mentioned above.

The blade storage member 52 is pivotally connected with the handle 12 and is constructed and arranged to carry the plurality of conventional blades 60. The blade storage member 52 is movable between a closed position (as shown, for example, in FIGS. 6 and 10) wherein the spare blades 60 are concealed, and a fully opened position wherein the user is permitted to access the spare blades 60. The utility knife 10 further includes the lock structure 50 that is constructed and arranged to releasably lock the blade storage member 52 in its closed position.

The exterior surface 94 of the blade storage member 52 is contoured to comfortably receive the fingers of the gripping hand of the user and the interior surface of the blade storage member 52 is shaped to abuttingly engage a corner portion 96 of each blade 60 stored therein (as shown in FIG. 3). In one embodiment, the interior surface of the blade storage member 52 includes support portions 120 (as shown in FIG. 3). The support portions 120 of the blade storage member 52 are constructed and arranged to support spare blades 60 that are stored in the blade storage member 52.

In one embodiment, an interengaging structure between the blade storage member 52 and the handle 12 prevents the movement of the blade storage member 52 from its closed position to its fully opened position under the force of gravity when the lock structure 50 is released to unlock the blade storage member 52 from its closed position. An interengaging structure, such as, a lip/detent arrangement described in detail, for example, U.S. Pat. No. 6,192,589, mentioned above may be used in the present invention. It should be appreciated that any other type of surface engagement between the blade storage member 52 and the handle 12 (e.g., a frictional engagement, etc.) that would prevent movement of the blade storage member 52 to the fully opened position under the force of gravity may be employed in the present invention. Thus, the present invention may require a force greater that the force of gravity to move the blade storage member 52 to its fully opened position.

The blade storage member 52 is pivotally mounted to the handle 12 of the utility knife 10 by a pair of transversely, oppositely extending cylindrical projections 62 integrally formed at a forward end 64 thereof. Each cylindrical projection 62 (only one of which is visible in FIG. 1) is pivotally received within a pair of transversely aligned cylinder bores 66 formed on the first handle portion 28 and the second handle portion 30 of the handle 12.

In one embodiment, the lock structure 50 is a flexible, resilient structure integrally molded on the blade storage member 52. The lock structure 50 includes a resilient, flexible portion 68, a lock surface 70 and a manually engageable portion 72. When the lock structure 50 is received within the aperture 48 of the upper gripping member 34, a lock surface 74 formed on the upper gripping member 34 releasably lockingly engages the lock surface 70 on the lock structure 50 to locking the blade storage member 52 in its closed position. In one embodiment, the resilient, flexible portion 68 of the lock structure 50 is constructed and arranged to be flexed out of locking engagement with the upper gripping member 34 to unlock the blade storage member 52. The blade storage member of the present invention may include different shapes, structures and/or constructions, for example, the blade storage member of the present invention may be in the form of the blade storage member as described in commonly assigned U.S. Pat. No. 6,192,589, mentioned above.

In the illustrated embodiment, two blade releasing structures 76 and 78 are associated with the first blade holder assembly 14 and the second blade holder assembly 16 respectively. The blade releasing structures 76 and 78 include manually engageable portions 80 and 82 that are movable to disengage the first blade 24 and the second blade 26 from the first blade holder assembly 14 and the second blade holder assembly 16 respectively, and thus, to enable the first blade 24 and the second blade 26 to be removed from the first blade holder assembly 14 and the second blade holder assembly 16 respectively. The release operation can be accomplished when the blades are in a fully extended, projecting position.

In one embodiment, the blade releasing structures 76 and 78 include attachment portions 84 and 86 constructed and arranged to be connected with the first handle portion 28 and the second handle portion 30 respectively. The attachment portions 84 and 86 of the blade releasing structures 76 and 78 are attached to the first handle portion 28 and the second handle portion 30 by any attachment mechanism or fastener as would be appreciated to one skilled in the art. In one embodiment, the attachment mechanism includes, but not limited to, fastening, bolting, riveting, or adhesive bonding.

In one embodiment, the blade releasing structures 76 and 78 are an integral, resilient structure made of a suitable molded plastic. The blade releasing structures 76 and 78 includes resilient arm members 88 and 90 that extends integrally outwardly from the manually engageable portions 80 and 82 to the attachment portions 84 and 86 at the opposite end thereof.

In one embodiment, the openings 92 of the first and the second handle portions 28 and 30 are constructed and arranged to permit lateral movement (inward and outward) of the manually engageable portions 80 and 82 with respect to the first handle portion 28 and the second handle portion 30 between a blade retaining position and a blade releasing position. In one embodiment, the resilient arm members 88 and 90 are constructed and arranged to bias the manually engageable portions 80 and 82 outwardly from the handle, toward its blade retaining position. The blade releasing structures of the present invention may include different shapes, structures and/or constructions, for example, the blade releasing structures of the present invention may in one embodiment take the form of the blade releasing structures as described in more detail in U.S. Pat. No. 3,577,637 which is hereby incorporated by reference in its entirety, and/or commonly assigned U.S. Pat. No. 6,192,589, mentioned above.

The interlock assembly 18 is a generally upright planar support portion 122 that includes a blocker structure 124, a first opening 126 and a second opening 128. In one embodiment, the upright planar support portion 122 is constructed and arranged to act as a dividing wall portion that separates the first blade holder assembly 14 and the second blade holder assembly 16 from each other. In one embodiment, the blocker structure 124 is constructed and arranged to be positioned between the first blade holder assembly 14 and the second blade holder assembly 16.

In one embodiment, the first opening 126 of the interlock assembly 18 is constructed and arranged to align with the opening 112 of the first handle portion 28 and the opening 114 of the second handle portion 30. In one embodiment, the threaded or other type of fastener 32 that is used to secure the first handle portion 28 and the second handle portion 30 is constructed and arranged to pass through the opening 112 of the first handle portion 28, the opening 114 of the second handle portion 30, and the first opening 126 of the interlock assembly 18 respectively to secure the interlock assembly 18 with both the first and second handle portions 28 and 30 of the utility knife 10. The second opening 128 can be used to provide clearance for the blade release structures 76 and 78. In one embodiment, the second opening 128 is constructed and arranged to provide a clearance for the central portion 162 of the second blade holder assembly 16 such that the central portion 162 of the second blade holder assembly 16 may flex into the clearance, when the blade release mechanism 78 is operated. Since only one of the first blade 24 and the second blade 26 is configured to project through the opening 20 at the front end 22 of the handle 12 at any one time, the clearance provided by the second opening 128 can also be used to receive the central portion of the first blade holder assembly 14, when the blade release mechanism 76 is operated.

In one embodiment, the blocker structure 124 of the interlock assembly 18 is constructed and arranged to deflect into and engage with a forward surface portion 130 of one of the first blade 24 and the second blade 26 if the other of the first blade 24 and the second blade 26 is moved through the opening 20 at the front end 22 of the handle 12, at least partially extended from the housing. In another embodiment, the blocker structure 124 of the interlock assembly 18 is constructed and arranged to deflect into and engage with a surface portion 132 of one of the first blade holder assembly 14 and the second blade holder assembly 16 if the other of the first blade holder assembly 14 and the second blade holder assembly 16 holds the first blade 24 or the second blade 26 at a position of use, at least partially extended from the housing.

In the illustrated embodiment, the blocker structure 124 of the interlock assembly 18 includes two resilient elongated members 134 and 136 that extend integrally from the upright planar support portion 122. In one embodiment, the resilient members 134 and 136 are constructed and arranged to be free at an end opposite from the upright planar support portion 122.

In one embodiment, the free end of the resilient member 134 includes a protrusion portion 138 (e.g., protruding outwardly from the upright planar support portion 122 towards the first blade holder assembly 14). In one embodiment, the protrusion portion 138 of the resilient member 134 has a curved cam surface 238 facing towards the first blade holder assembly 14. The cam surface 238 is engaged and forced towards the second blade holder assembly 16 and the first blade holder assembly 14 is slid forward to project the first blade 24 outwardly from the housing. As a result, the protrusion portion 138 is deflected into and engages with the surface portion 132 of the second blade holder assembly 16 to prevent the second blade holder assembly 16 from moving forwardly to expose second blade 26 if the first blade 24 is moved through the opening 20 at the front end 22 of the handle 12.

In one embodiment, the free end of the resilient member 136 includes a protrusion portion 140 (e.g., protruding outwardly from the upright planar support portion 122 towards the second blade holder assembly 16). In one embodiment, the protrusion portion 140 of the resilient member 136 has a curved cam surface 240 facing towards the second blade holder assembly 16. The cam surface 240 is engaged and forced towards the first blade holder assembly 14 and the second blade holder assembly 16 is slid forward to project the second blade 26 outwardly from the housing. As a result, the protrusion portion 140 is deflected into and engages with the surface portion 132 of the first blade holder assembly 14 if the second blade 26 is moved through the opening 20 at the front end 22 of the handle 12.

According to one embodiment, it is contemplated that the blocker structure 124 may include a single resilient member (e.g., one such structure is shown in FIGS. 17-21 and described in the second embodiment of the present invention) instead of having two resilient members as described in the illustrated embodiment. In such embodiment, the single resilient member may include a sphere or ellipsoidal or spheroid or ball-shaped structure at the free end thereof. In one embodiment, the ball-shaped structure is constructed and arranged to deflect into and to engage with the surface portion 132 of one of the first blade holder assembly 14 and the second blade holder assembly 16 if the other of the first blade holder assembly 14 and the second blade holder assembly 16 holds the first blade 24 or the second blade 26 at a position of use, or a surface portion 130 of one of the first blade 24 and the second blade 26 if the other of the first blade 24 and the second blade 26 is moved through the opening 20 at the front end 22 of the handle 12 at any one time.

As shown in the illustrated embodiment, the first blade 24 may be different from the second blade 26. In the illustrated embodiment, the first blade 24 has a trapezoidal shape, a longest side of which includes the linear cutting edge 142. A shorter side 144 of the first blade 24 includes at least one locating notch 144*a*, 144*b* configured to mate with a complementary blade engaging protrusion 146 provided on the first blade holder assembly 14 to prevent the first blade 24 from moving longitudinally forwardly or rearwardly out of engagement with the first blade holder assembly 14.

In the illustrated embodiment, the second blade 26 has a trapezoidal shape with one or more hook-shaped cut-out portions 148 formed within the second blade 26. In one embodiment, such hook-shaped cut-out portions 148 are formed near both ends of the second blade 26. In one embodiment, the cutting edge 150 is located along the edge of the hook-shaped cut-out portions 148 of the second blade 26. Similar to the first blade 24, a shorter side 154 of the second blade 26 includes at least one locating notch (not shown) configured to mate with a complementary blade engaging protrusion 152 provided on the second blade holder assembly 16 to prevent the second blade 24 from moving longitudinally forwardly or rearwardly out of engagement with the second blade holder assembly 16.

In one embodiment, the second blade 26 may be referred to as "hook blade" or "edge protection blade" or "roofing utility blade" and is used for cutting and trimming roofing materials, fabric, cartons, sheet material and/other similar material. In embodiment, the depth of hook-shaped cut-out portions 148 is larger for cutting thicker materials. In one embodiment, indicia may be laser etched on the second blade 26 to prevent accidental mixing with the standard utility blades (e.g., the first blade 24 in the illustrate embodiment). It is should be appreciated, however, that the hook-shaped blade in the illustrated embodiment is but one example of different types of blade that can be provided. In one embodiment, the hook-shaped blade may be placed in the first blade holder assembly 14 and the trapezoidal shaped blade with the linear cutting edge may be placed in the second blade holder assembly 16.

Figure 12:
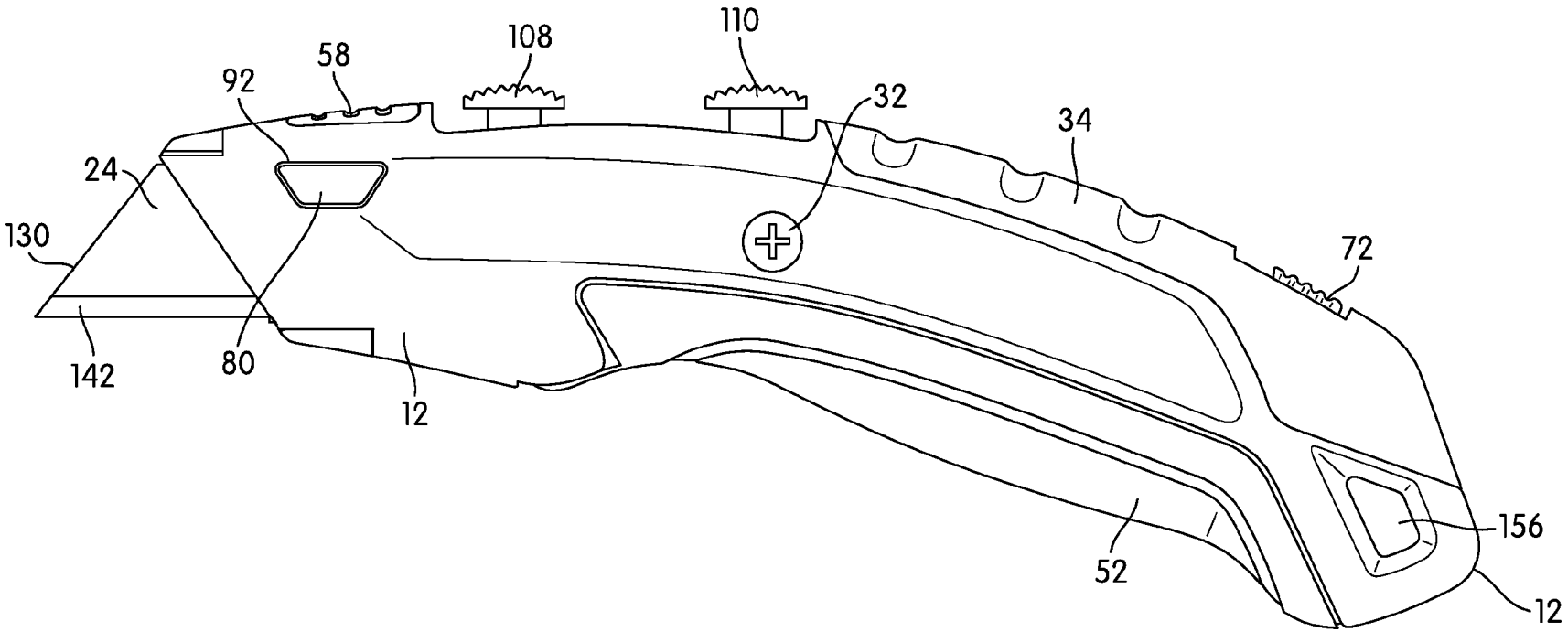
FIG. 12 is a left side view of the utility knife, wherein the first blade projects through the opening in the front end of the handle and the second blade is retracted into the handle in accordance with an embodiment of the present invention.
Figure 15:
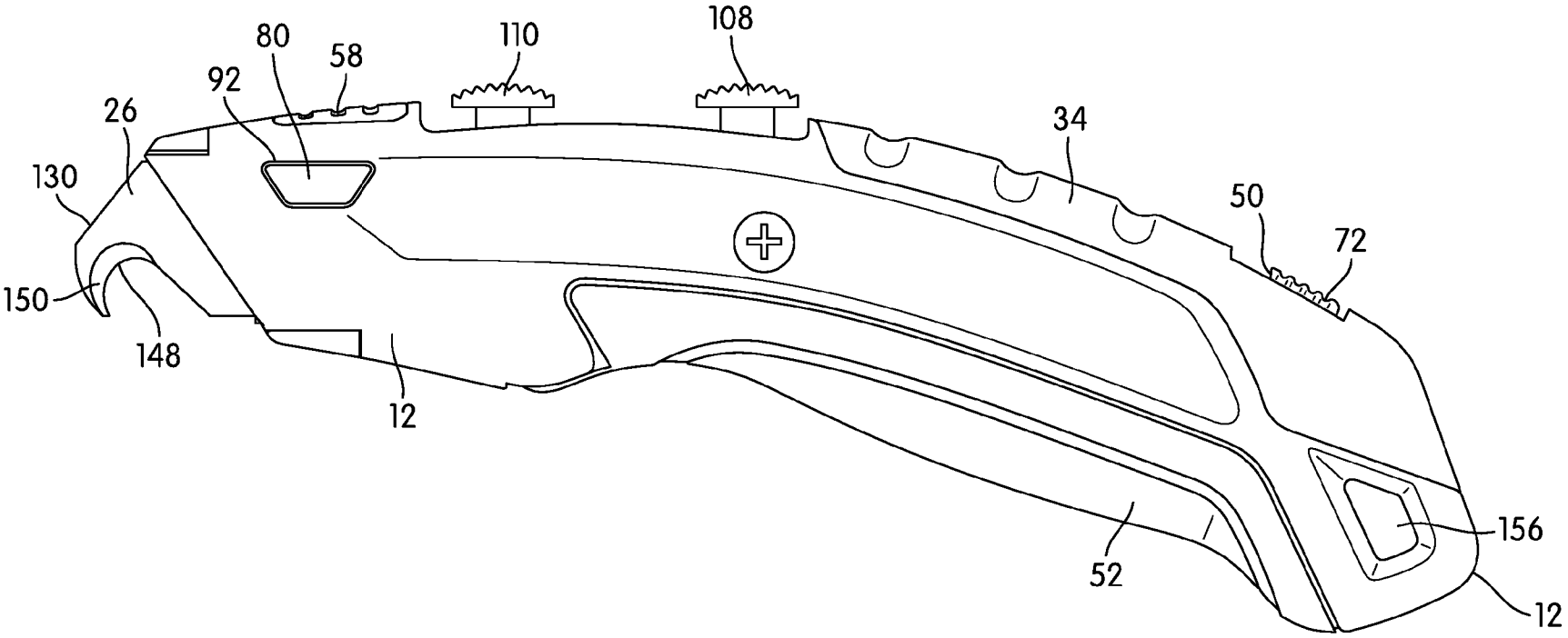
FIG. 15 is a left side view of the utility knife, wherein the first blade is retracted into the handle and the second blade projects through the opening at the front end of the handle in accordance with an embodiment of the present invention.

The operation of the interlock assembly 18 is described in detail with respect to FIGS. 1 and 11-16. FIGS. 11-13 show the utility knife 10 with the first blade holder assembly 14 in an extended position, while the second blade holder assembly 16 is in a retracted position. FIGS. 14-16 show the utility knife 10 with the second blade holder assembly 16 in an extended position, while the first blade holder assembly 14 is in a retracted position.

Starting when both blades are retracted, the first blade holder assembly 14 can be moved from the retracted position (as shown in the FIGS. 2-10) to the extended position (as shown in the FIGS. 11-13) in the direction of an arrow A. In one embodiment, the user uses the manually engageable member 108 attached to the first blade holder assembly 14 to move the first blade holder assembly 14 and the first blade 24 contained therein in the direction of the arrow A from the retracted position to the extended position. The movement of the first blade holder assembly 14 from the retracted position to the extended position causes the protrusion portion 138 of the resilient member 134 of the interlock assembly 18 to deflect into and engage with the surface portion 132 of the second blade holder assembly 16, or the surface portion 130 of the second blade 26, thus, allowing only the first blade 24 of the first blade holder assembly 14 to project through the opening 20 at the front end 22 of the handle 12. In other words, the interlock assembly 18 blocks the movement of the second blade holder assembly 16 and the second blade 26 contained therein if the first blade 24 is moved through the opening 20 at the front end 22 of the handle 12, thus, preventing both the first blade 24 and the second blade 26 from being projected through the opening 20 at the front end 22 of the handle 12 simultaneously.

Similarly, when both blades are retracted the second blade holder assembly 16 can be moved from the retracted position (as shown in the FIGS. 2-10) to the extended position (as shown in the FIGS. 14-16) in the direction of an arrow B. In one embodiment, the user uses the manually engageable member 110 attached to the second blade holder assembly 16 to move the second blade holder assembly 16 and the second blade 26 contained therein in the direction of the arrow B from the retracted position to the extended position. The movement of the second blade holder assembly 16 from the retracted position to the extended position causes the protrusion portion 140 of the resilient member 136 of the interlock assembly 18 to deflect into and engage with the surface portion 132 of the first blade holder assembly 14, or the surface portion 130 of the first blade 24, thus, allowing only the second blade 26 of the second blade holder assembly 16 to project through the opening 20 at the front end 22 of the handle 12. In other words, the interlock assembly 18 blocks the movement of the first blade holder assembly 14 and the first blade 24 contained therein if the second blade 24 is moved through the opening 20 at the front end 22 of the handle 12, thus, preventing both the first blade 24 and the second blade 26 from being projected through the opening 20 at the front end 22 of a handle 12 simultaneously.

The operation of the blade releasing structures 76 and 78 is discussed with respect to FIG. 1. In order to release the second blade 26 from the handle 12, the user after moving the manually engageable member 110 into the fully extended position (as shown in FIG. 14), depresses the manually engageable portions 82 of blade releasing structure 78, thereby causing a surface portion 158 of the blade releasing structure 78 to move into abutting engagement with an intermediate flange 160 on the second blade holder assembly 16. Continued transverse inward movement of the manually engageable portion 82 of the blade releasing structure 78 thereafter causes a central portion 162 of the second blade holder assembly 16 to resiliently move out of its equilibrium position, thereby moving the blade engaging protrusion 152 from a blade locking position to a blade releasing position. While holding the manually engageable portion 82 in its blade releasing position, the user can then slide the second blade 26 forwardly out of the second blade holder assembly 16 and either insert a new blade or turn the old blade 180 degrees and reinsert the old blade so that a sharp edge thereof is exposed. The user then releases the manually engageable portion 82 to allow the blade engaging protrusion 152 to move back into locking engagement with the second blade 26. The utility knife 10 is again ready for use in a cutting operation. The operation of the blade releasing structure 76 for the first blade holder assembly 14 is similar to the operation of the blade releasing structure 78, described above, and hence, will not be described in detail.

Figure 17:
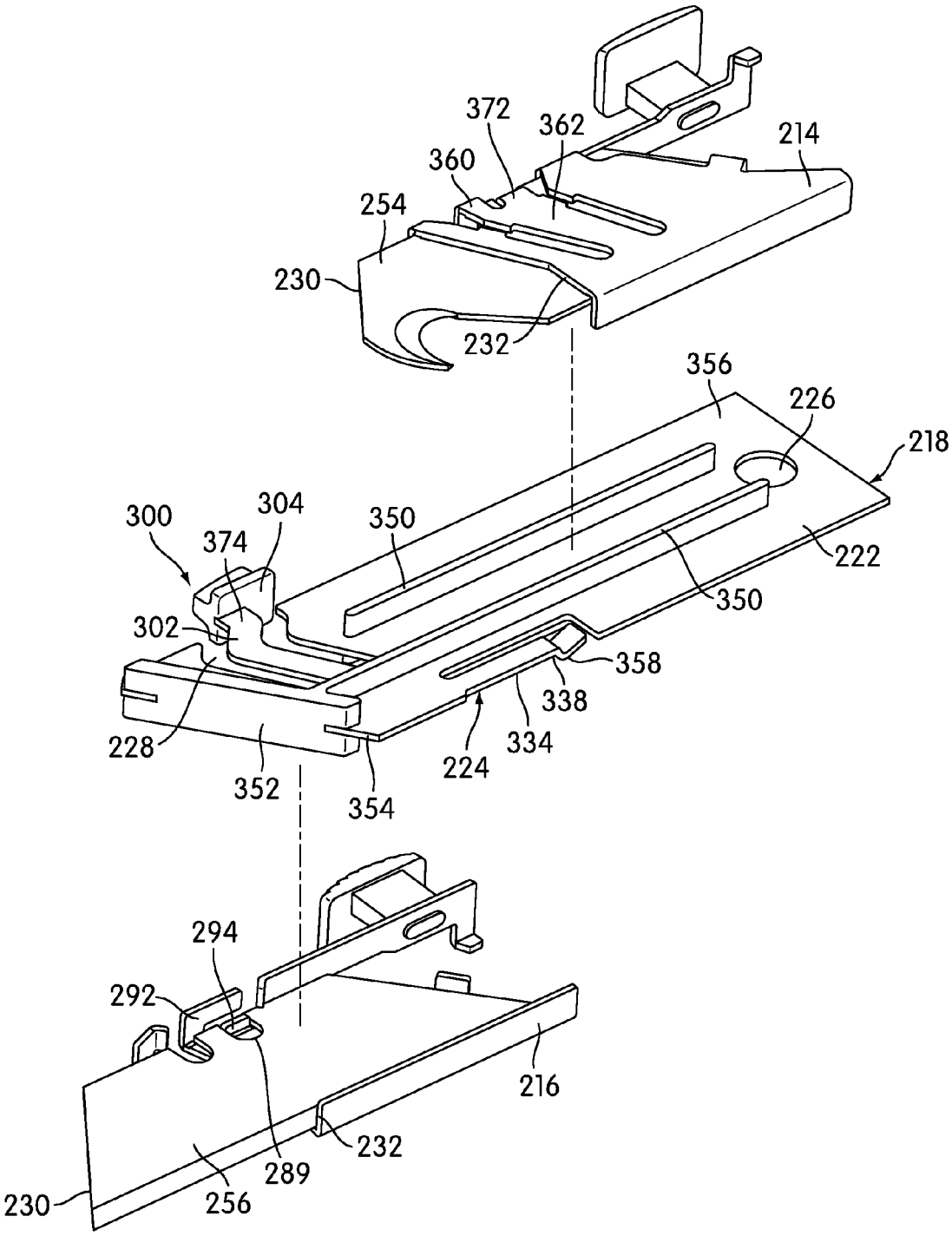
FIG. 17 is a partial exploded view of the utility knife with the first blade holder assembly, the second blade holder assembly, and the interlock assembly in accordance with another embodiment of the present invention.

FIGS. 17-21 show another embodiment of the present invention. FIG. 17 shows a first holder assembly 214, a second blade holder assembly 216 and an interlock assembly 218 of the utility knife. The structure of the utility knife (i.e., handle with two mating handle portions, upper gripping member, blade storage member, thumb grip member) in this embodiment is the same or similar to that of the utility knife 10 described in the earlier embodiment, and hence only some differences will be described in detail here.

As shown in FIG. 17, the interlock assembly 218 has a generally upright planar support portion 222 that includes a blocker structure 224, a first opening 226 (e.g., circular in shape), and a second opening or slot 228. The upright planar support portion 222 is constructed and arranged to act as a dividing wall portion that separates the first blade holder assembly 214 and the second blade holder assembly 216 from each other. In one embodiment, the blocker structure 224 is constructed and arranged to be positioned between the first blade holder assembly 214 and the second blade holder assembly 216.

The blocker structure 224 of the interlock assembly 218 is constructed and arranged to deflect into and engage with a forward surface portion 230 of one of the first blade 254 and the second blade 256 if the other of the first blade 254 and the second blade 256 is moved through the opening at the front end of the handle, at least partially extended from the housing. In another embodiment, the blocker structure 224 of the interlock assembly 218 is constructed and arranged to deflect into and engage with a surface portion 232 of one of the first blade holder assembly 214 and the second blade holder assembly 216 if the other of the first blade holder assembly 214 and the second blade holder assembly 216 holds the first blade 254 or the second blade 256 at a position of use, at least partially extended from the housing.

In the illustrated embodiment as shown in FIG. 17, the blocker structure 224 of the interlock assembly 218 includes a single resilient elongated member 334 (i.e., instead of two resilient elongated members described in the previous embodiment) that extends integrally (or in an alternate embodiment, formed separately and attached) from the upright planar support portion 222. In one embodiment, the resilient member 334 is constructed and arranged to be free at an end opposite from the upright planar support portion 222.

Figure 19:
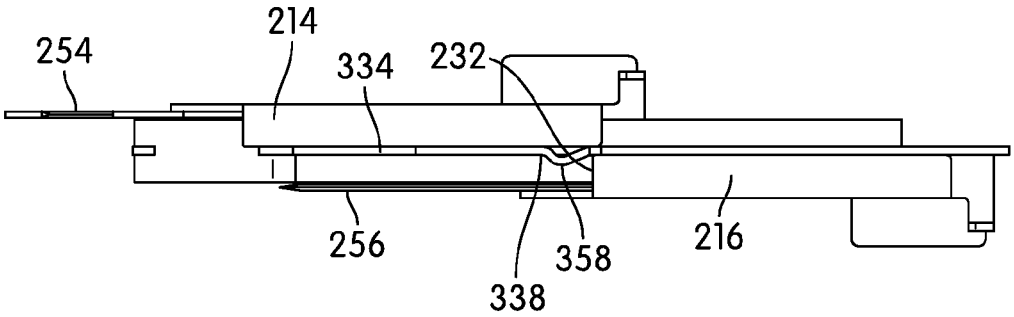
FIG. 19 is a bottom plan view of the utility knife, wherein the first blade projects through the opening at the front end of the handle and the second blade is retracted into the handle in accordance with another embodiment of the present invention.

In one embodiment, the free end of the resilient member 334 includes a protrusion portion 338 (also referred to as a blocking portion or member) protruding outwardly from the upright planar support portion 222 towards the second blade holder assembly 216 as shown in FIG. 19. In one embodiment, the protrusion portion 338 of the resilient member 334 has a curved cam and/or lock surface 358 facing towards the second blade holder assembly 214. If the first blade holder assembly 214 is slid forward to project the first blade 254 outwardly from the housing, the cam surfaces 358 is in a position that blocks forward movement of the second blade assembly 216. The resilient member 334 cannot be deflected or displaced out of blocking relation with the second blade holder assembly 216 (and/or the blade 256 thereof) because the first blade holder assembly 214 occupies the space to which the resilient member 334 and protrusion 338 thereof would be moved towards during a camming action. As a result, the protrusion portion 338 operates as a stop or lock against the surface portion 232 of the second blade holder assembly 216 to prevent the second blade holder assembly 216 from moving forwardly to expose second blade 256 if the first blade 254 is moved through the opening 220 at the front end 252 of the handle (See FIG. 19).

Figure 22:
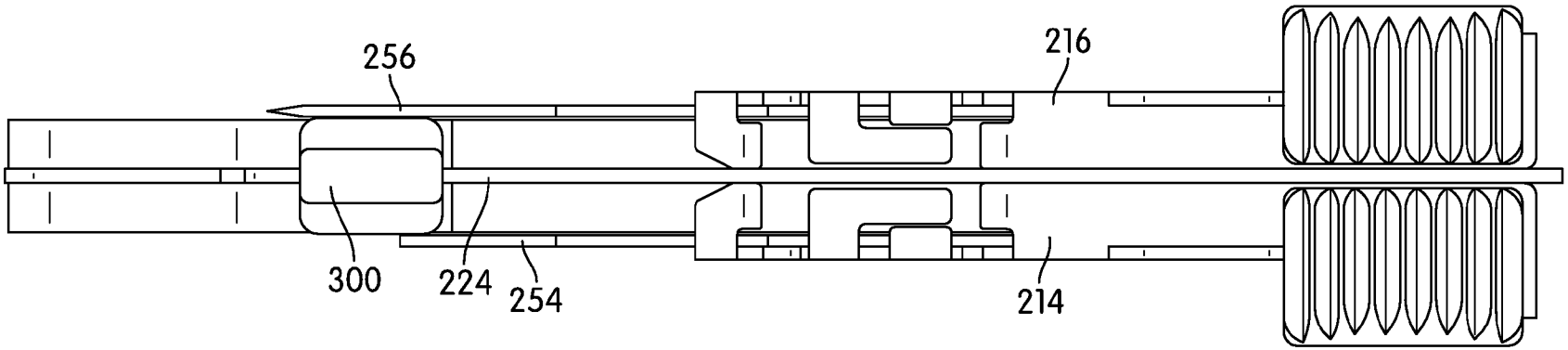
FIG. 22 is a top plan view of the utility knife, wherein the first blade and the second blade are retracted into the handle in accordance with another embodiment of the present invention.

When both blades are retracted (as shown in FIG. 22), if the second blade holder assembly 216, is extended from the housing, the cam surface 358 is engaged by the second blade holder assembly 216 or blade 256 carried thereby and forced towards the first blade holder assembly 214. As a result, the protrusion portion 338 engages with the surface portion 232 of the first blade holder assembly 214 to prevent the first blade holder assembly 214 from moving forwardly to expose the first blade 254 if the second blade 256 is moved through the opening at the front end of the handle (See FIG. 21). When the blade 256 is subsequently retracted after a cutting operation, the resiliency of the resilient member 334 returns it to the at rest position. At this point, either blade can be extended to the exclusion of the other by operation of the interlock assembly 218, such as by operation of the resilient member 334 and protrusion or blocking portion 338.

Figure 18:
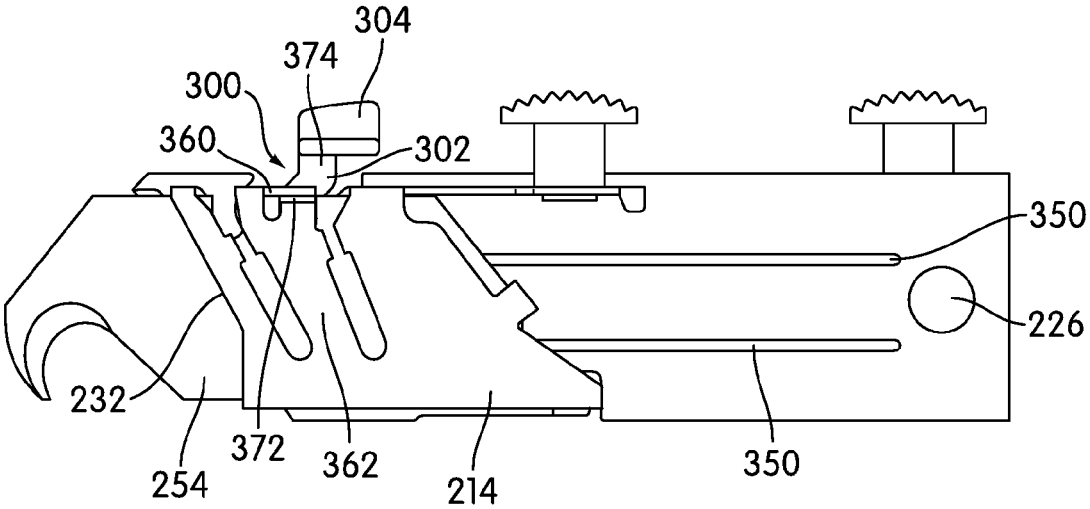
FIG. 18 is a left side view of the utility knife, wherein the first blade projects through the opening in the front end of the handle and the second blade is retracted into the handle in accordance with another embodiment of the present invention.
Figure 20:
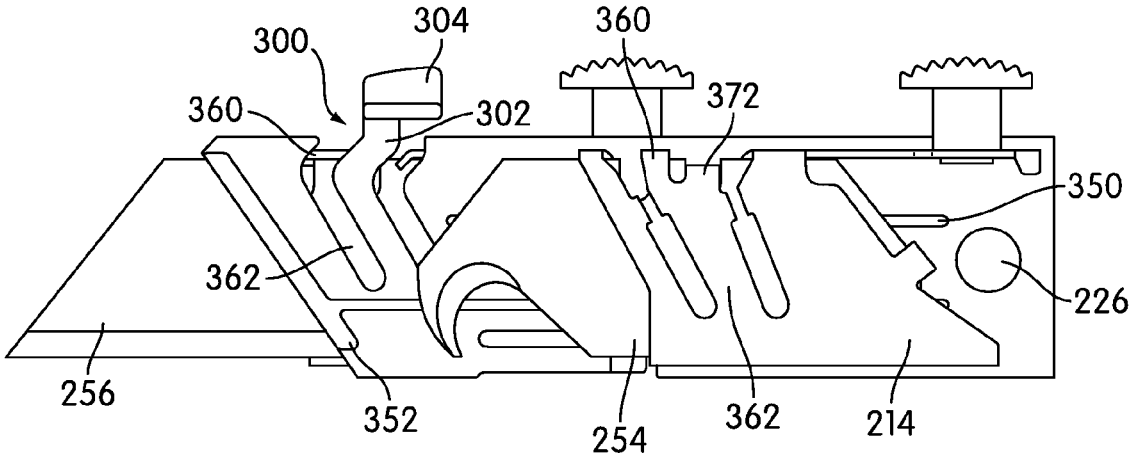
FIG. 20 is a left side view of the utility knife, wherein the first blade is retracted into the handle and the second blade projects through the opening at the front end of the handle in accordance with another embodiment of the present invention.
Figure 21:
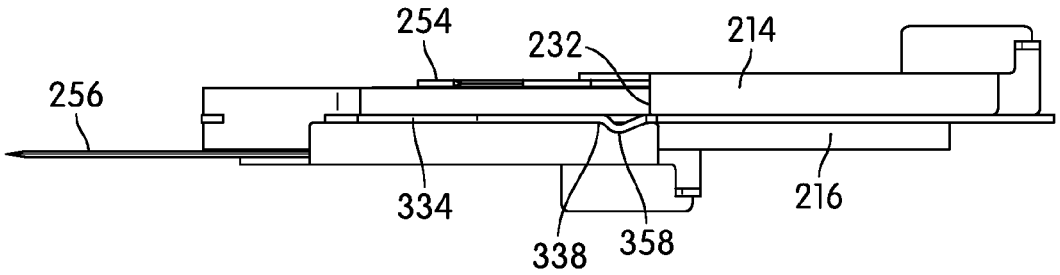
FIG. 21 is a bottom plan view of the utility knife, wherein the first blade is retracted into the handle and the second blade projects through the opening at the front end of the handle in accordance with another embodiment of the present invention.

As shown in FIGS. 17, 18 and 20, the interlock assembly 218 includes a blade releasing structure 300. In one embodiment, the blade releasing structure 300 is located along a central plane of the knife. The blade releasing structure 300 includes a resilient elongated member 302 that extends integrally from the upright planar support portion 222. In one embodiment, the resilient member extends vertically upwards through the second opening or slot 228 of the upright planar support portion 222. In one embodiment, the resilient member 302 is constructed and arranged to be free at an end opposite from the upright planar support portion 222. In one embodiment, the free end of the resilient member 302 includes a manually engageable member 304.

The operation of the blade releasing structure 300 is discussed with respect to FIGS. 17, 18 and 20. In order to release the first blade 254 from the handle it is first extended through the opening at the front end of the handle to its fully extended position. At this position, an intermediate flange 360 on the first blade holder assembly 214 is aligned with a surface portion 374 of the resilient member 302. The user then moves the manually engageable member 304 of the blade change structure 300 laterally (perpendicular to the longitudinal or axial direction of blade movement) towards the first blade holder assembly 214, thereby causing the surface portion 374 of the resilient member 302 of the blade releasing structure 300 to move into abutting engagement with the intermediate flange 360 on the first blade holder assembly 214 (See FIG. 18). Continued movement of the manually engageable portion 304 of the blade releasing structure 300 towards the first blade holder assembly 214 thereafter causes a central portion 362 of the first blade holder assembly 214 to resiliently move out of its equilibrium position, thereby moving a blade engaging protrusion 372 of the central portion 362 from a blade locking position to a blade releasing position. As noted earlier, in the blade locking position, the blade engaging protrusion 372 provided on the first blade holder assembly 214 is configured to mate with a locating notch (not shown, but, similar to locating notch 289 on the second blade 256 as shown in FIG. 17) on the first blade 254 to prevent the first blade 254 from moving longitudinally forwardly or rearwardly out of engagement with the first blade holder assembly 214 during use. While holding the manually engageable portion 304 in its blade releasing position, the blade engaging protrusion 372 of the central portion 362 is disengaged from the locating notch on the first blade 254, and the user can then slide the first blade 254 forwardly out of the first blade holder assembly 214 and either insert a new blade or turn the old blade 180 degrees and reinsert the old blade so that an opposite sharp edge thereof is exposed. The user then releases the manually engageable portion 304 to allow the blade engaging protrusion 372 to move back into locking engagement with the notch in the new (or reversed) blade. The utility knife is again ready for use in a cutting operation.

Figure 23:
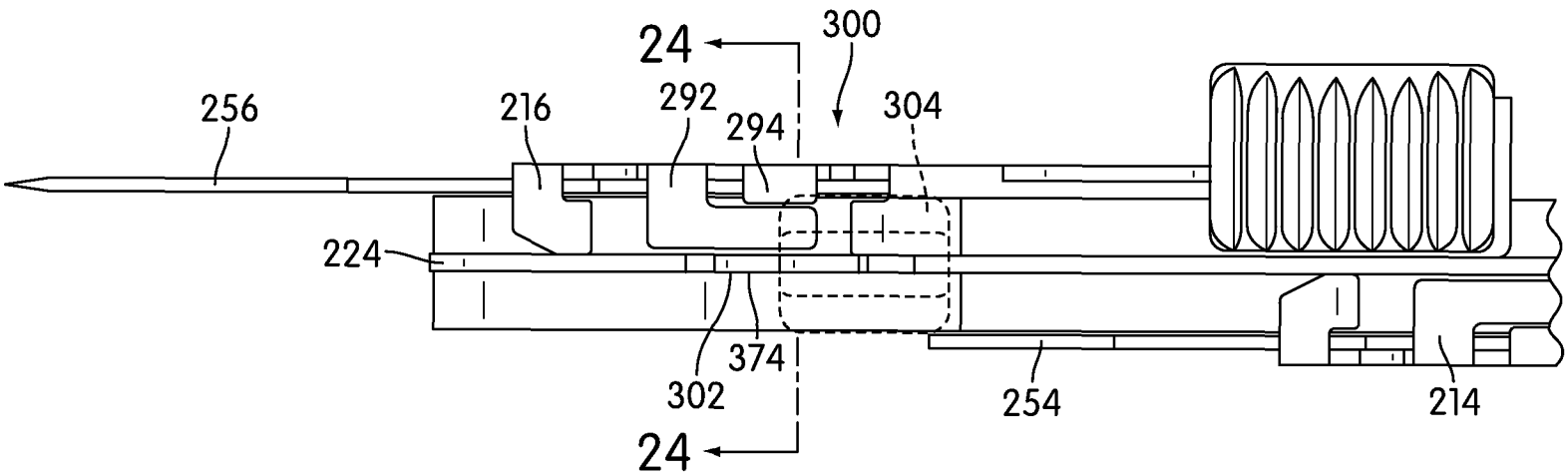
FIG. 23 is a top plan view of the utility knife illustrating the operation of blade releasing structure, wherein an intermediate flange on the second blade holder assembly is aligned with a surface portion of a resilient member of the blade releasing structure is shown in accordance with an embodiment of the present invention.
Figure 24:
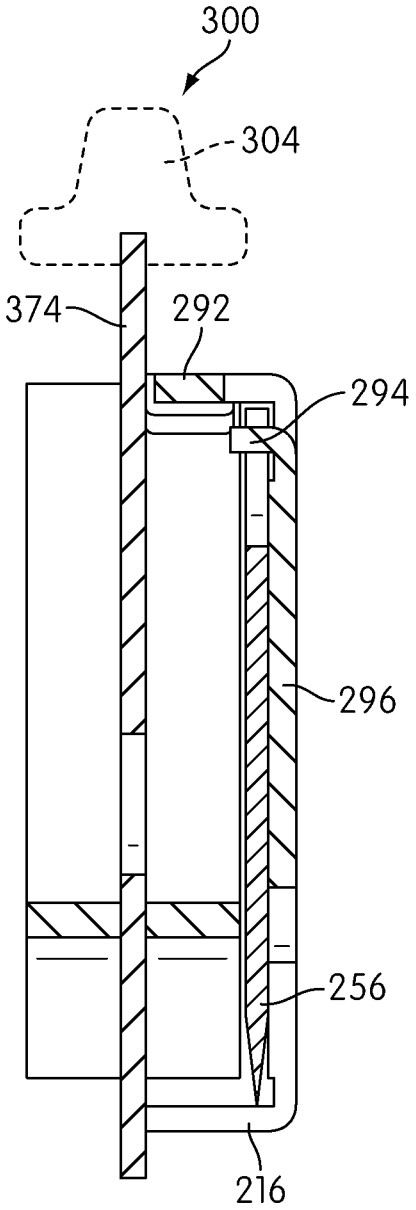
FIG. 24 is a sectional view thereof along the line 24-24 of FIG. 23 in accordance with an embodiment of the present invention.
Figure 25:
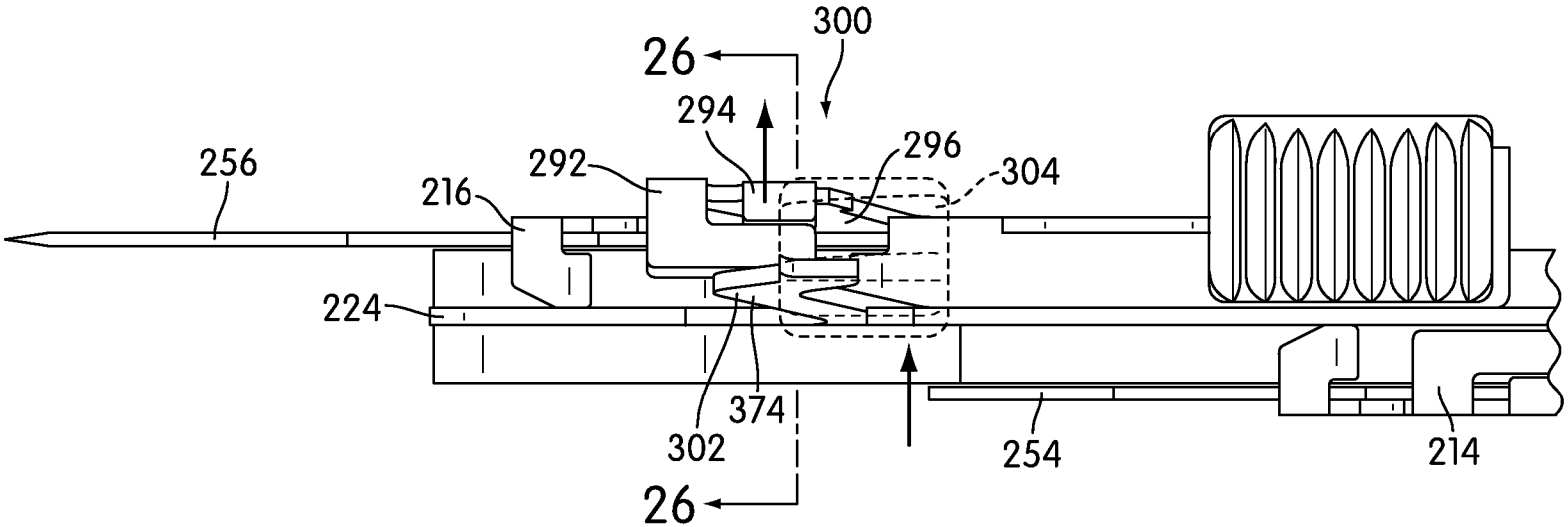
FIG. 25 is a top plan view of the utility knife illustrating the operation of blade releasing structure, wherein a central portion of the second blade holder assembly is resiliently moved out of its equilibrium position by the blade releasing structure in accordance with an embodiment of the present invention.
Figure 26:
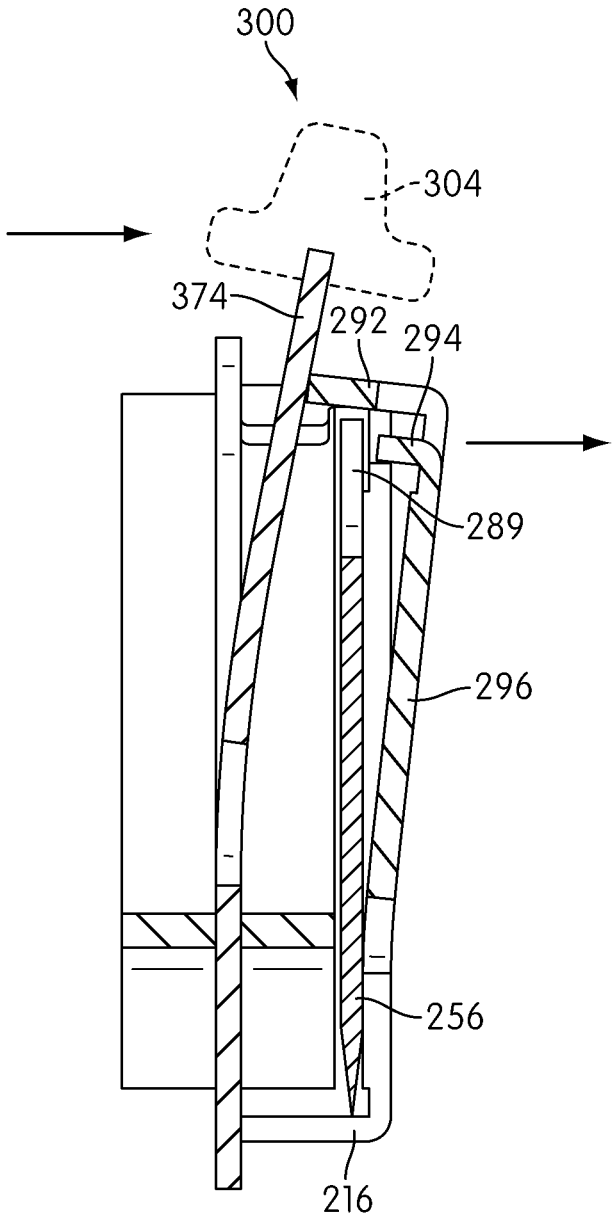
FIG. 26 is a sectional view thereof along the line 25-25 of FIG. 26 in accordance with an embodiment of the present invention.
Figure 27:
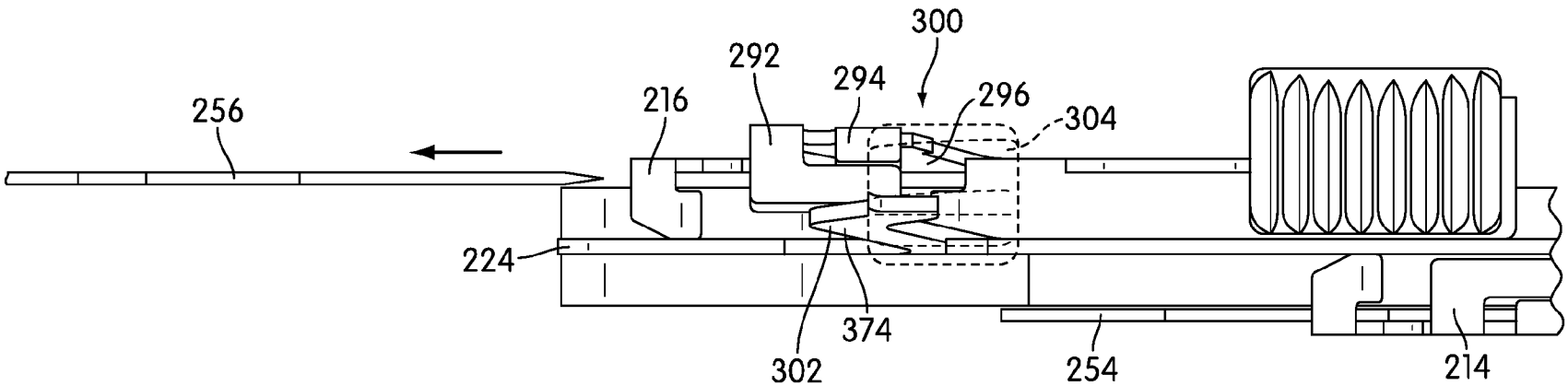
FIG. 27 is a top plan view of the utility knife illustrating the operation of blade releasing structure, wherein the second blade is slid forwardly out of the second blade holder assembly in accordance with an embodiment of the present invention.

In a similar manner, as shown in FIGS. 17, 20, and 23-27, in order to release the second blade 256 from the handle it is first extended fully (to its maximum extension) through the opening at the front end of the handle. At this position, as shown in FIG. 23, an intermediate flange 292 on the second blade holder assembly 216 is aligned with the surface portion 374 of the resilient member 302. The user then moves the manually engageable member 304 of the blade change structure 300 laterally (perpendicular to the longitudinal or axial direction of blade movement) towards the second blade holder assembly 216, thereby causing the surface portion 374 of the resilient member 302 of the blade releasing structure 300 to move into abutting engagement with the intermediate flange 292 on the second blade holder assembly 216. As shown in FIG. 25, continued movement of the manually engageable portion 304 of the blade releasing structure 300 towards the second blade holder assembly 216 thereafter causes a central portion 296 of the second blade holder assembly 216 to resiliently move out of its equilibrium position, thereby moving a blade engaging protrusion 294 from a blade locking position to a blade releasing position. As noted earlier, in the blade locking position, the blade engaging protrusion 294 (as shown in FIG. 17) provided on the second blade holder assembly 216 is configured to mate with a locating notch 289 (as shown in FIG. 17) on the second blade 256 to prevent the second blade 256 from moving longitudinally forwardly or rearwardly out of engagement with the second blade holder assembly 216 during use. While holding the manually engageable portion 304 in its blade releasing position, the blade engaging protrusion 294 of the central portion 296 of the second blade holder assembly 216 is disengaged from the locating notch 289 on the second blade 256, and the user can then slide the second blade 256 forwardly out of the second blade holder assembly 216 (as shown in FIG. 27) and either insert a new blade or turn the old blade 180 degrees and reinsert the old blade so that an opposite sharp edge thereof is exposed. The user then releases the manually engageable portion 304 to allow the blade engaging protrusion to move back into locking engagement with the notch 289 in the new (or reversed) blade. The utility knife is again ready for use in a cutting operation.

In one embodiment, as shown in FIG. 17, the upright planar support portion 222 of the interlock assembly 218 includes a plurality of ribs 350 located on the side surfaces 356 thereof. In one embodiment, the plurality of ribs 350 are constructed and arranged to support the first blade 254 in the first blade holder assembly 214 and/or the second blade 256 in the second blade holder assembly 216. In one embodiment, a support member 352 is located on a front end 354 of the upright planar support portion 222 of the interlock assembly 218. In one embodiment, the support member 352 is constructed and arranged to support the first blade 254 in the first blade holder assembly 214 as the first blade 254 projects through the opening at the front end of the handle, or the second blade 256 in the second blade holder assembly 216 as the second blade 256 projects through the opening at the front end of the handle.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A utility knife, comprising:

a handle having a front end;

a first blade holder assembly constructed and arranged to releasably hold a first replaceable cutting blade at a position of use wherein the first replaceable cutting blade projects outwardly from a first opening at the front end of the handle, and to retract the first replaceable cutting blade into the handle;

a second blade holder assembly constructed and arranged to releasably hold a second replaceable cutting blade at a position of use wherein the second replaceable cutting blade projects outwardly from a second opening at the front end of the handle, and to retract the second replaceable cutting blade into the handle, wherein the first cutting blade and the second cutting blade each have a forward terminal end; and an interlock assembly comprising a blocker structure positioned within the handle and between the first blade assembly and the second blade assembly and constructed and arrange to allow only one of the first replaceable cutting blade or the second replaceable cutting blade at a time to project outwardly from the front end of the handle, wherein the first replaceable cutting blade comprises a first linear edge, a first cutting edge opposite the first linear edge and a first mounting notch formed in the first linear edge, and the second replaceable cutting blade comprises a second linear edge, a second cutting edge opposite the second linear edge and a second mounting notch formed in the second linear edge, wherein the first blade holder has a first blade engaging protrusion and the second blade holder has a second blade engaging protrusion, wherein the first blade engaging protrusion engages within the first mounting notch to retain the first replaceable cutting blade in a fixed longitudinal position relative to the first blade holder and the second blade engaging protrusion engages within the second mounting notch to retain the second replaceable cutting blade in a fixed longitudinal position relative to the second blade holder, wherein a surface of the first or second blade holder assembly deflects the blocker structure into locking engagement with the other of the first or second blade holder assembly when the first or second blade holder assembly is moved from a retracted position within the handle to a position of use, to prevent the first blade and the second blade from being projected out the front end of the handle simultaneously, and wherein the first replaceable cutting blade and the second replaceable cutting blade are constructed and arranged to be aligned with their respective openings when the first replaceable cutting blade and the second replaceable cutting blade are positioned within the handle, and wherein the forward terminal ends of the first cutting blade and of the second cutting blade are offset from a central axis of the handle when projecting outwardly from the front end of the handle.

2. The utility knife of claim 1, wherein the blocker structure is constructed and arranged to deflect into and engage with a surface portion of one of the first replaceable cutting blade and the second replaceable cutting blade if the other of the first replaceable cutting blade and the second replaceable cutting blade is moved through an opening at the front end of the handle at any one time.

3. The utility knife of claim 1, further comprising a wall portion constructed and arranged to divide an opening at the front end into the first opening through which the first replaceable cutting blade projects and the second opening through which the second replaceable cutting blade projects.

4. The utility knife of claim 1, wherein the first replaceable cutting blade is different from the second replaceable cutting blade.

5. The utility knife of claim 1, further comprising a blade storage member pivotally connected with the handle, wherein the blade storage member is constructed and arranged to carry spare cutting blades.

6. The utility knife of claim 5, wherein the blade storage member is movable between a closed position wherein the spare cutting blades are concealed and a fully opened position permitting access to the spare cutting blades.

7. The utility knife of claim 6, wherein the blade storage member comprises a lock structure constructed and arranged to lock the blade storage member in the closed position.

8. The utility knife of claim 1, further comprising a first blade release structure cooperable with the first blade holder and movable to a release position that enables the first blade holder to release a blade held thereby.

9. The utility knife of claim 8, further comprising a second blade release structure cooperable with the second blade holder and movable to a release position that enables the second blade holder to release a blade held thereby.

* * * * *